US007159950B2

(12) United States Patent
Young-Chul

(10) Patent No.: US 7,159,950 B2
(45) Date of Patent: Jan. 9, 2007

(54) COSMETICS BRUSH AND MANUFACTURING METHOD OF THE SAME

(76) Inventor: Byun Young-Chul, 206-1702, UjangsanLotteNakchundaeApt, 1145, Hwagok-dong, Gangseo-Gu, Seoul 157-010 (KR)

( * ) Notice: Subject to any disclaimer, the term of this patent is extended or adjusted under 35 U.S.C. 154(b) by 330 days.

(21) Appl. No.: 10/792,868

(22) Filed: Mar. 5, 2004

(65) Prior Publication Data

US 2005/0138746 A1 Jun. 30, 2005

(30) Foreign Application Priority Data

Dec. 26, 2003 (KR) ..... 10-2003-0097226

(51) Int. Cl.
*A46D 3/04* (2006.01)
*A46B 3/00* (2006.01)

(52) U.S. Cl. ..... 300/21; 300/8; 15/207.2; 40/314; 156/72

(58) Field of Classification Search ..... 300/21, 300/8; 15/191.1, 207.2, DIG. 6; 132/320; 40/314; D4/127, 135; 156/63, 72
See application file for complete search history.

(56) References Cited

U.S. PATENT DOCUMENTS 1,923,884 A * 8/1933 Pushee ..... 300/21
4,519,110 A * 5/1985 Rubin ..... 15/159.1
6,224,287 B1 * 5/2001 Gieux ..... 401/282
2003/0182750 A1 * 10/2003 Nishida et al. ..... 15/193

FOREIGN PATENT DOCUMENTS

CA 0884771 * 11/1971

* cited by examiner

*Primary Examiner*—Gladys J P Corcoran
*Assistant Examiner*—Laura C Guidotti
(74) *Attorney, Agent, or Firm*—Birch, Stewart, Kolasch & Birch, LLP

(57) ABSTRACT

The present invention relates to a cosmetics brush for making-up 30 including an inner brush member 10 and an outer brush member 20 separated each other, wherein the inner brush member 10 has a color different from that of the outer brush member 20 to express specific design and/or pattern of logo and is fitted into inner side of the outer brush member 20 to be integrated together and, a method for producing such cosmetics brush. The produced cosmetics brush 30 can express the desirable logo by both of the inner and the outer brush members 10 and 20; thereby it allows the user of such cosmetics brush to easily recognize the company or products thereof from the logo represented by the brush and accomplishes effectiveness of advertising, in addition to function its true duty as the cosmetics brush 30.

3 Claims, 4 Drawing Sheets

COSMETICS BRUSH AND MANUFACTURING METHOD OF THE SAME

This non-provisional application claims priority under 35 U.S.C. § 119(a) based on patent application Ser. No. 2003-0097226 filed in Korea on Dec. 26, 2003, the subject matter of which is herein incorporated by reference.

BACKGROUND OF THE INVENTION

1. Field of the Invention

The present invention relates to a cosmetics brush, more particularly, a cosmetics brush including a main body mounted with an inner brush member and an outer brush member, the inner brush member having a logotype (abbrev. to "logo") with desirable design or pattern to be represented by applying different colors of brush hair and being fitted inside the outer brush member, and a method for manufacturing the cosmetics brush. The cosmetics brush formed as described above is purposed to accomplish effectiveness of advertising for a company or products thereof expressed by the desired logo on the brush in addition to function its true duty.

2. Description of the Related Art

Conventional cosmetics brush is generally constructed by adhering a brush member inside alternative clip to be fixed and inserting the fixed brush to top portion of a main body forming the cosmetics brush, or directly fitting the brush member into the top portion of the main body.

Such cosmetics brush typically includes the brush member with a single color such as white or black color on the top portion of the main body and is applicable only for makeup. Thus, the cosmetics brush is not substantially distinguished from ones by other manufacturers so that it has a problem to cause users to be easily tired of the brush and not to satisfy different tastes of the users preferring new and striking in design.

SUMMARY OF THE INVENTION

It is, therefore, an object of the present invention is to solve the above problem, in particular, to provide a cosmetics brush including a main body mounted with an inner brush member and an outer brush member, the inner brush member having a logo with desirable design or pattern to be represented by applying different colors of brush hair and being fitted into inner side of the outer brush member, and a method for manufacturing the cosmetics brush.

The present cosmetics brush formed as described above functions not only its true duty as the brush, but also represents effectiveness of advertising for a specific company or products thereof expressed by the desired logo on the brush, thereby making users to easily recognize the company and/or products thereof.

BRIEF DESCRIPTION OF THE DRAWINGS

The above object, features and advantages of the present invention will become more apparent to those skilled in the related art from the following detailed description for preferred embodiments taken in conjunction with the accompanying drawing, in which.

DETAILED DESCRIPTION OF THE PREFERRED EMBODIMENT

The present invention will be described in more detail be reference to the accompanying drawings and following embodiments which are presented for purpose of illustration and should not be construed to limit the scope of the invention thereto.

Figure 1:
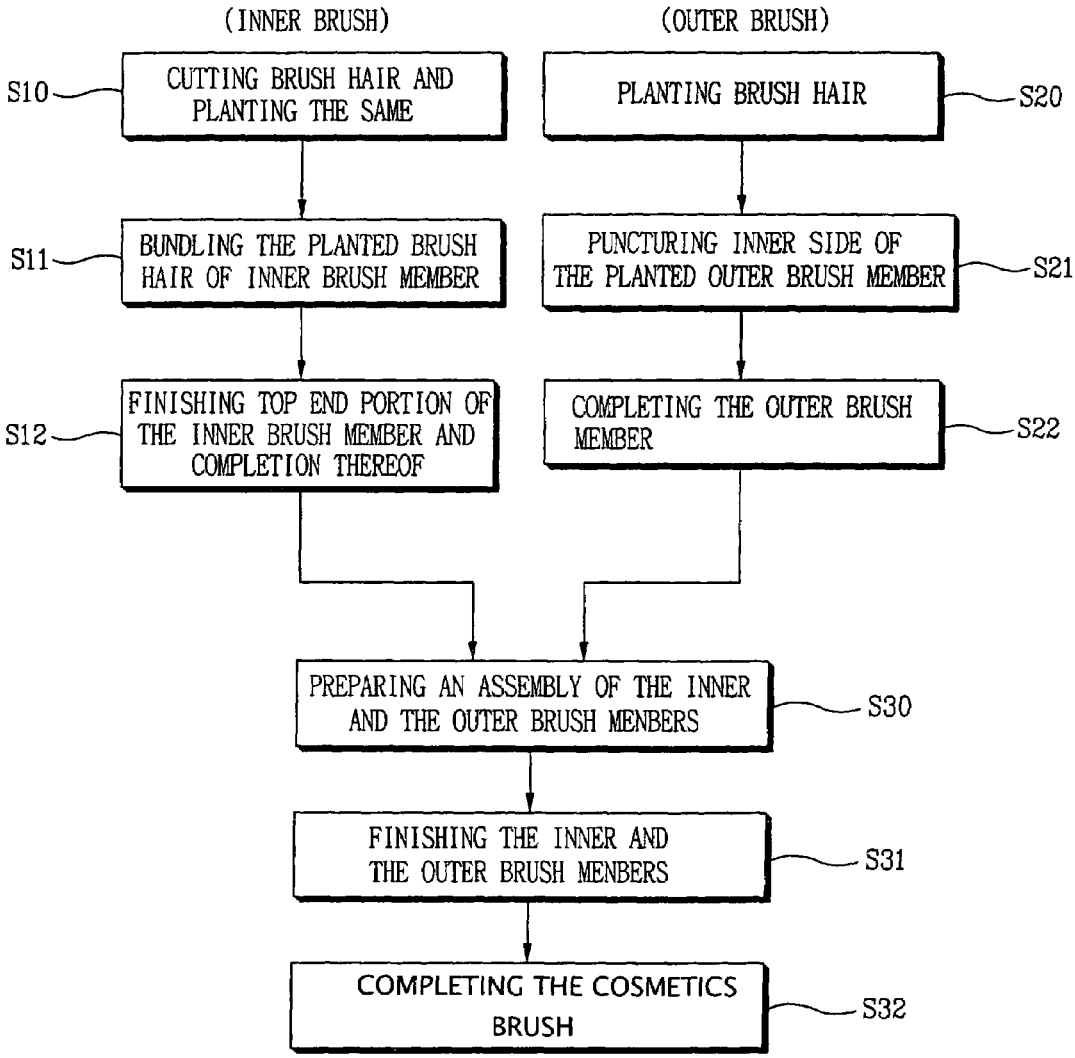
FIG. 1 is a block diagram illustrating a process for manufacturing a cosmetics brush according to the present invention.
Figure 2:
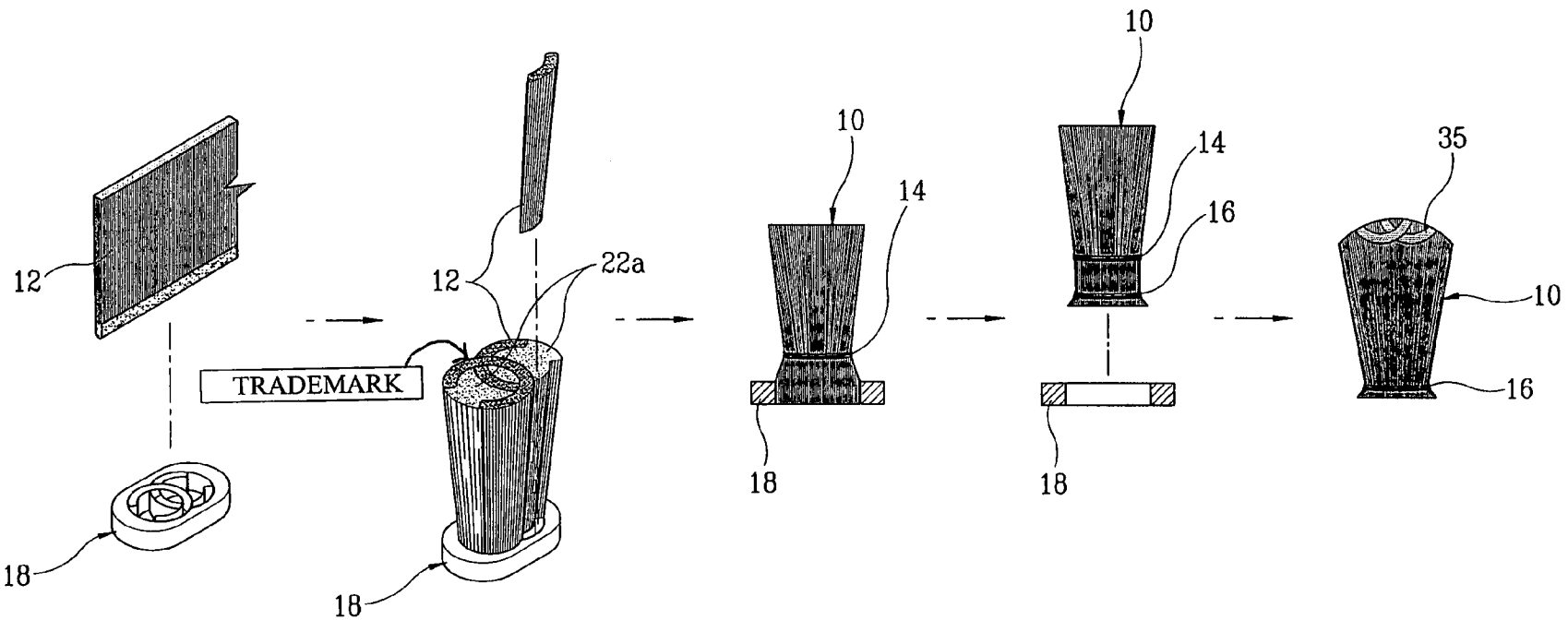
FIG. 2 is an illustrated view of inner brush member mounted in the cosmetics brush according to the present invention.
Figure 3:
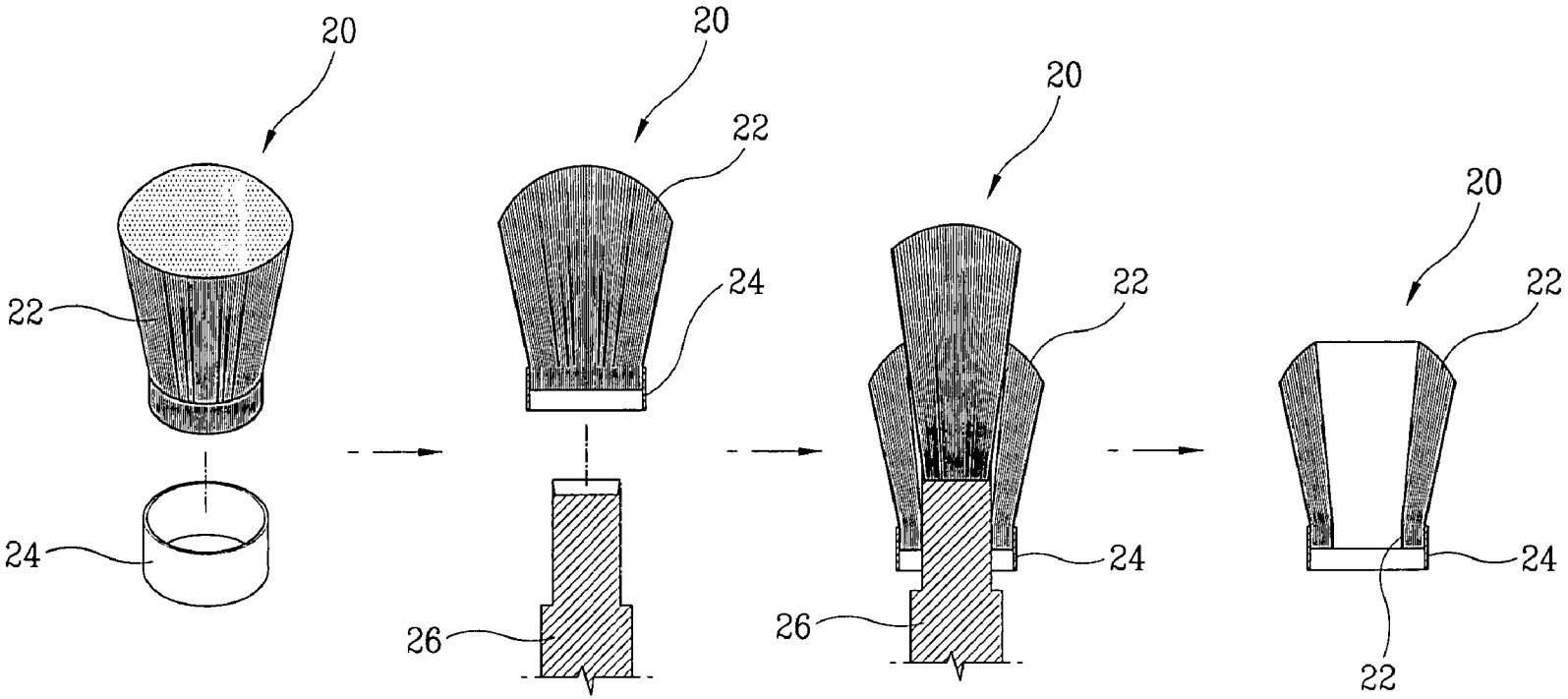
FIG. 3 is an illustrated view of outer brush member mounted in the cosmetics brush according to the present invention.
Figure 4:
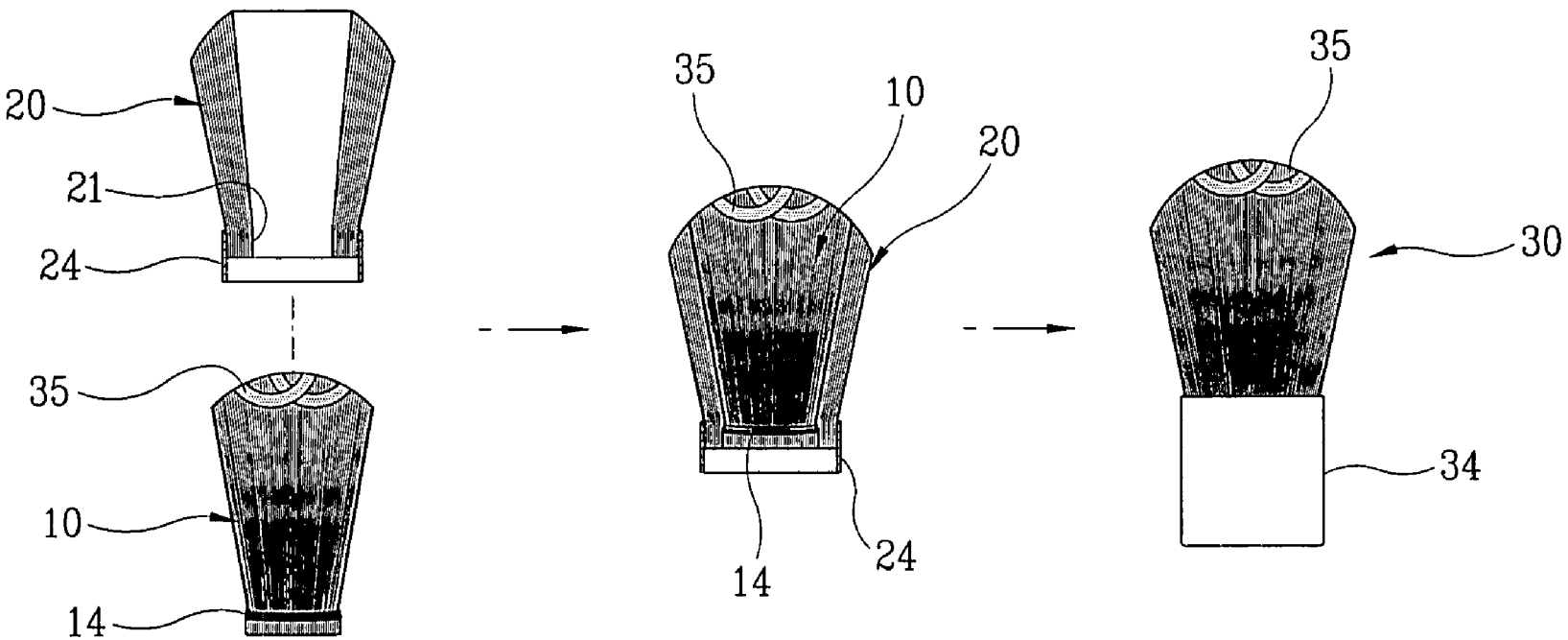
FIG. 4 is an illustrated view of the cosmetics brush as an integrated assembly with the inner and the outer brush members by fitting them into the brush.

The present invention provides a cosmetics brush 30 including an inner brush member 10 and an outer brush member 20, both of which are individually manufactured, and integrated and completed into the cosmetics brush 30 in an assembly form by fitting the inner brush member 10 into inner side of the outer brush member 20. Respective steps of a process for manufacturing the present cosmetics brush 30 will be described as follows:

FIG. 1 illustrates a block diagram showing a process for manufacturing the present cosmetics brush. FIG. 2 is an illustrated view of inner brush member mounted in the cosmetics brush according to the present invention. FIG. 3 is an illustrated view of outer brush member mounted in the cosmetics brush according to the present invention. Also, FIG. 4 is an illustrated view of the cosmetics brush as an integrated assembly with the inner and the outer brush members by fitting them into the brush.

Referring to FIG. 1, the present inventive process includes first multiple steps of cutting brush hair and planting the hair S10; making bundles of hair for the inner brush member S11; finishing top end of the inner brush member and completing the inner brush member S12;

second multiple steps of planting and fixing brush hair for the outer brush member S20; puncturing inner side of the outer brush member S21 after the brush hair planting step; completing the outer brush member S22; and third multiple steps of integrating the inner and the outer brush members S30; finishing both of the members S31; and completing the final cosmetics brush product S32.

The resultant cosmetics brush 30 manufactured by the process as described above is formed by fitting the inner brush member 10 having a logo 35 with desirable design or pattern to be represented by applying different colors of brush hair into the inner side of the outer brush member 20.

Such constructed cosmetics brush 30 is not only applicable to paint one's face, but also allows the user to clearly and easily recognize a manufacturer of the brush and/or other products thereof by the brush having the logo 35 with the desired design or pattern to be represented by applying different colors of the brush hair and, simultaneously, provides effectiveness of advertising so that it has an advantage of being distinguished from similar products of other manufacturers.

An embodiment for the cosmetics brush of the present invention having such construction described above will be more understood with reference to the following description.

First, the inner brush member 10 of the cosmetics brush will be prepared by the following steps (See FIGS. 1 and 2);

First step for forming the inner brush member: cutting brush hair and planting the same S10.

The brush hair 12 which is adhered at bottom thereof by a constant thickness is continuously formed in a single direction and entered into a framework 18 having a desirable logo, thereby cutting the brush hair 12 into a desirable size and planting the same.

Herein, the brush hair 12 is planting with the color desirably selected to express the logo 35 and, more preferably, has a color well matched with the color of brush hair 22 of the outer brush member 20.

Further, the inner brush member 10 is planted by another brush hair 22*a* on the rest area other than the brush hair 12 having the desired logo, then integrated with the brush hair 12.

Second step for forming the inner brush member: bundling the planted brush hair S11.

The inner brush member 10 having two kinds of the brush hair with the desired logo pattern and/or design by different colors planted in the logo framework 18 is under the bundling process by doing up middle lower portion of the inner brush member 10 in a first bundle band 14 and drawing the bundled brush 10 out of the framework 18, then making a second bundle band 16 with bottom portion of the first bundle band 14.

Third step for forming the inner brush member: finishing top end portion of the inner brush member and completion thereof S12.

The inner brush member 10 formed above is under a cutting and finishing process for top portion thereof while releasing the first bundle band 14 from the second step to result in the final brush product.

After the completion of third step, it results production of the inner brush member 10 representing the logo 35.

Alternatively, the outer brush member 20 of the cosmetics brush will be prepared by the following steps (See FIGS. 1 and 3);

First step for forming the outer brush member: planting brush hair S20.

Brush hair 22 is planting inside a ring fixture 24 in a desirable form and integrated by adhering bottom end portion of the planted brush hair 22 with adhesive.

Herein, the planted brush hair 22 is planting with alternative color distinguishable from the color of logo to be expressed on the inner brush member 10.

Second step for forming the outer brush member: puncturing inner side of the planted outer brush member S21.

While finishing top portion of the outer brush member 20 formed by the first step, lower inner side of the outer brush member 20 is under the puncturing process using punching device 26.

In this case, the punctured portion has a diameter sufficient to receive and fit the inner brush member 10 inside.

Third step for forming the outer brush member: completing the outer brush member S22.

By the above finishing and puncturing processes, the completed outer brush member 20 is obtainable.

Meanwhile, the finishing process for the top portion of the outer brush member 20 may be carried out after fitting and securing the brush hair 22 into the ring fixture 24 in the first step, or during the third step.

After then, the present cosmetics brush 30 is finally obtained by fitting the produced inner brush member 10 having the logo 35 into the outer brush member 20 according to the following steps (See FIGS. 1 and 4):

First step for forming the present cosmetics brush: preparing an assembly of the inner and the outer brush members S30.

The inner brush member 10 is assembled with the outer brush member 20 by fitting the inner brush member 10 into the outer brush member 20, both of which have been produced as described above.

Such inner brush member 10 is preferably secured into the outer brush member 20 by a process of enclosing top portion of the brush hair 12 with vinyl material and/or cloth having elevated sliding friction coefficient (not seen in figures) to make the brush hair 12 in a streamline form suitable to be inserted into a punctured hole 21 in the lower inner side of the outer brush member 20, then drawing the streamlined brush hair 12 out of top portion of the outer brush member 20.

Second step for forming the present cosmetics brush: finishing the inner and the outer brush members S31.

This step is for finishing top end portion of the brush hair formed by integrating both of the inner and the outer brush members 10 and 20.

This finishing step may be carried out and/or eliminated by manufacturers, if not required.

Third step for forming the present cosmetics brush: completing the resent cosmetics brush S32.

By mounting a clip 34 on bottom end portion of the finished brush as a grip, the cosmetics brush is completed.

As a result, the obtained cosmetics brush clearly represents specified logo 35 expressed on the inner brush member 10 with different colors matched together to the naked eye by forming the assembly of both brush members 10 and 20.

The present invention provides the cosmetics brush 30 representing the desired logo 35 by integrating the outer brush member 20 having a background color and the inner brush member 10 expressing desirable characters and/or figures. Accordingly, it will be understood that such construction of the cosmetic brush 30 having the logo 35 established by using different colors of brush hair is within the scope of the present invention.

As described above, the cosmetic brush of the present invention is formed by fitting the inner brush member representing the desired logo with different colors of brush hair into inner side of the outer brush member so that it allows any users of such cosmetics brush to easily recognize a specific company or products manufactured by the company from the desirable pattern and/or design of logo represented by the brush hair having different colors and achieve effectiveness of advertising, in addition to a purpose of making-up of the brush; accordingly, the present invention provides the cosmetics brush as a valuable product with improvement of quality.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for producing a cosmetics brush including the steps of:

cutting a first color of brush hair into a constant size and planting the hair into a logo framework in a shape of a logo;

making bundles of hair for an inner brush member by bundling a middle lower portion and a bottom end portion of the inner brush member which are planted into the logo framework;

completing the inner brush member by finishing a top portion of the inner brush member into a desired shape and releasing the middle lower portion of the inner brush member to obtain a completed product expressed with a logo;

planting brush hair for an outer brush member by planting brush hair having a second color different from the logo of the inner brush member inside a ring fixture having a form and adhering a bottom portion of the brush hair;

puncturing an inner side of the outer brush member by puncturing an inner side of the brush hair by means of a punching device so that the size of the punctured inner side of the outer brush corresponds to the size of said inner brush member;

completing the outer brush member by finishing a top end portion of the punctured outer brush member;

integrating the inner and the outer brush members by fitting the inner brush member into the punctured portion of the inner side of the outer brush member;

finishing the top end portion of the integrated inner and the outer brush members; and completing a final cosmetics brush product by mounting a clip as a grip of the cosmetics brush on a bottom end portion of the brush.

2. A process according to claim 1, wherein said bundles of hair for an inner brush member are a third color different from said first and second colors.

3. A process according to claim 1, wherein said bundles of hair for an inner brush member are said second color.

* * * * *